US009487741B2

(12) United States Patent
Demertzis et al.

(10) Patent No.: US 9,487,741 B2
(45) Date of Patent: Nov. 8, 2016

(54) USE OF NITROGEN COMPOUNDS IN THE PICKLING OF STAINLESS STEEL

(71) Applicant: HENKEL AG & CO. KGAA, Duesseldorf (DE)

(72) Inventors: Ioannis Demertzis, Milan (IT); Mauro Rigamonti, Opera (IT); Paolo Giordani, Crema (IT); Paolo Gamboggi, Milan (IT)

( * ) Notice: Subject to any disclaimer, the term of this patent is extended or adjusted under 35 U.S.C. 154(b) by 0 days.

(21) Appl. No.: 14/445,147

(22) Filed: Jul. 29, 2014

(65) Prior Publication Data

US 2014/0334965 A1 Nov. 13, 2014

Related U.S. Application Data

(63) Continuation of application No. PCT/EP2013/051891, filed on Jan. 31, 2013.

(30) Foreign Application Priority Data

Feb. 2, 2012 (GB) ..... 1201824.8

(51) Int. Cl.
*C23G 1/08* (2006.01)
*C11D 7/08* (2006.01)

(52) U.S. Cl.
CPC . *C11D 7/08* (2013.01); *C23G 1/08* (2013.01); *C23G 1/086* (2013.01)

(58) Field of Classification Search
CPC ..... C23G 1/061; C23G 1/08; C23G 1/081; C23G 1/086; C11D 7/08
See application file for complete search history.

(56) References Cited

U.S. PATENT DOCUMENTS

| | | | |
|---|---|---|---|
| 3,085,915 A | 4/1963 | Heitmann et al. | |
| 6,554,908 B1 * | 4/2003 | Negri | C23C 22/34 134/19 |

FOREIGN PATENT DOCUMENTS

| | | | |
|---|---|---|---|
| CA | 2353387 | A1 | 6/2000 |
| DE | 135406 | A1 | 5/1979 |
| EP | 0505606 | B1 | 11/1995 |
| GB | 877240 | * | 9/1961 |

OTHER PUBLICATIONS

International Search Report for PCT/EP2013/051891, 2 pages.

* cited by examiner

*Primary Examiner* — Brian P Mruk
(74) *Attorney, Agent, or Firm* — Mary K. Cameron

(57) ABSTRACT

The present invention relates to an acidic aqueous solution suitable for the pickling of stainless steel grades that comprises accelerators based on water soluble inorganic compounds comprising at least one nitrogen atom in an oxidation state in the range of −2 to −⅓. The present invention further encompasses a process for the pickling of stainless steel that makes use of a pickling solution comprising the above-mentioned accelerators.

16 Claims, No Drawings

USE OF NITROGEN COMPOUNDS IN THE PICKLING OF STAINLESS STEEL

The present invention relates an acidic aqueous solution suitable for the pickling of stainless steel grades that comprises accelerators based on water soluble inorganic compounds comprising at least one nitrogen atom in an oxidation state in the range of −2 to −⅓. The present invention further encompasses a process for the pickling of stainless steel that makes use of a pickling solution comprising the above-mentioned accelerators.

In the rolling, drawing, extrusion, heat treatment of steel products (such as wires, plates, strips, tubes, rods) oxide layers are formed on the surface thereof which must be removed both to get proper final appearance as well as passivity and anticorrosive properties for the final product, and to allow further working.

Said superficial oxide layers are usually eliminated by a chemical treatment (pickling) based on exposition of the metallic material to the action of one or more acid baths containing inorganic mineral acids (sulfuric, hydrochloric, nitric, hydrofluoric) alone or mixed with one another, at proper dilution and temperature, followed by at least one final rinsing in water.

For stainless steels, the usual pickling processes (either by immersion, spraying or turbulence) require a mixture of nitric and hydrofluoric acids; such processes entrain very serious ecological problems due to emission of the reaction byproducts (extremely toxic nitrogen oxides) into the atmosphere as well as of great quantities of nitrates into waste water. Hence, during the recent past a number of alternative "ecological" processes have been devised characterized by the elimination of nitric acid.

The ecological drawback of pickling solutions based on nitric acid was overcome in making use of sulfuric acid as a main acid component in the pickling of stainless steel. EP 0505606 discloses such a nitric acid free pickling bath comprised of sulfuric acid, hydrofluoric acid and ferric ions wherein the pickling capability of the acidic solution is maintained by the addition of hydrogen peroxide.

The continuous demand from the market of an increase of the efficiency of pickling practice led to the development of an improved process described in EP 1050605 that discloses a nitric acid free pickling solution comprised of sulfuric acid, hydrofluoric acid, ferric ions and an amount of chloride ions. This type of pickling solution that differs from the conventional nitric acid free pickling solutions only by the presence of chloride ions was found to be suitable for the pickling of a variety of stainless steel grades when adjusted in a way that the redox potential is maintained at a value of above +230 mV. EP 1050605 as well teaches to maintain the redox potential by the addition of oxidizing agents, e.g. stabilized hydrogen peroxide.

Despite the good applicability of this nitric acid free pickling solution comprising chloride, these solutions sometimes over etch the stainless steel surface due to their increased pickling performance giving rise to significant corrosion and blackening of the metallic surface. Furthermore, the use of chloride ions in the pickling process might impose the risk of corrosive pitting of the already descaled and brightened stainless steel.

In this context the object of the invention consists in further increasing the pickling rate of conventional nitric acid free pickling solutions and thereby to improve the efficiency of the pickling process of stainless steel grades itself. It is a further object not to have to rely on chloride ions as an accelerator for the pickling of steel and to weaken the attack of the stainless steel base material during the pickling treatment.

It was surprisingly found that specific inorganic compounds that comprise at least one nitrogen atom in an oxidation state in the range of −2 to −⅓ are capable of increasing the pickling rate of acidic aqueous solutions with a sufficient oxidation potential based on strong acids and iron ions.

Therefore, the present invention consists in a process for the pickling of stainless steel wherein a stainless steel surface is brought into contact with a pickling solution comprising a) 0.2 to 2.1 mol/l of at least one strong free acid with a pK-value of the first deprotonation step below 2.5;
b) 0.4 to 7.9 mol/l of total fluoride;
c) 0.25 to 2 mol/l of iron ions;
d) at least 0.01 g/l calculated on a nitrogen basis of one or more accelerators based on water soluble inorganic compounds comprising at least one nitrogen atom in an oxidation state in the range of −2 to −⅓ (hereinafter "accelerators");

wherein the redox potential of the pickling bath is at least +230 mV.

The term "stainless steel" in the context of the present invention encompasses austenitic, ferritic and martensitic steels as well as duplex steels, superaustenitic and superferritic steels and Ni-based or Ni/Cr-based superalloys.

The term "free acid" with regard to the present invention means the acid that does not constitute the anion bound in the form of a salt or complex with the metal ions present in the pickling solution.

The "free acid" content of those acids with a pK-value for the first deprotonation step of below 2.5 can be determined on the basis of the electrical conductivity of the pickling solution. For this purpose the pickling solution has to be brought to a pre-established degree of dilution, preferably at least 1:20, and the electrical conductivity has to be determined at the pickling temperature and compared with an appropriate calibration curve of standard solutions comprising known amounts of the same acids as comprised in the pickling solution ("Conductivity Method"). The Conductivity Method is based on the fact that the electrical conductivity of the solution containing strong acids and hydrofluoric acid in practice represents the total amount of the strong acids with a pK value below 2.5 as the strong acids complete dissociate in equimolar amounts of protons, whereas the free hydrofluoric acid is mainly present in the form of undissociated hydrofluoric acid, and consequently makes a negligible contribution to the electrical conductivity. The conductivity method is described in more detail in EP 1141686 B1 within the paragraphs [0046]-[0061]. This disclosure is herein incorporated by reference.

All electrochemical potentials herein refer to the Ag/AgCl/saturated KCl electrode unless otherwise stated.

With regard to this invention a compound reveals water solubility when its solubility in deionised water ($\kappa<10^{-6}$ $\mu Scm^{-1}$) in either dissociated or undissociated form is at least 1 g/l at a temperature of 25° C.

The term "oxidation state" according to this invention is defined by the corresponding IUPAC Rule I-5.5.2.1 ("Nomenclature of Inorganic Chemistry—Recommendations 1990", Blackwell: Oxford, 1990) and thereby defines the hypothetical charge an atom might be imagined to have when electrons are counted in accordance with the electronegativity of the respective elements that assemble the molecule or salt, while the element with the higher electronegativity gathers all the electrons shared with elements that are less electronegative.

It is essential for a pickling process according to this invention that the pickling solution comprises a minimum amount of accelerators based on water soluble inorganic compounds comprising at least one nitrogen atom in an oxidation state in the range of −2 to −⅓, preferably in the range of −1 to −⅓. These type of compounds considerably increase the pickling rate of the pickling solution and thereby accelerate the pickling process as a whole. In a preferred pickling process the amount of these accelerators within the pickling solution is at least 0.1 g/l, more preferably at least 0.5 g/l calculated on a nitrogen basis in order to ensure a significant and sustained acceleration of the pickling action.

On the other hand amounts of these accelerators in excess of 20 g/l calculated on a nitrogen basis do not further improve the pickling rate. It is therefore preferred for economic reasons that the amount of accelerators in a pickling solution of a pickling process according to this invention is not more than 20 g/l, preferably not more than 5 g/l calculated on a nitrogen basis.

Among possible accelerators those accelerators are preferred in a pickling process according to the invention that are selected from hydrazine, hydrazoic acid and/or hydroxylamine and their respective water soluble salts, more preferably from hydrazoic acid and/or hydroxylamine and their respective water soluble salts, especially preferred from hydroxylamine and their respective water soluble salts. Among the salts of hydroxylamine $(NH_3OH)Cl$, $(NH_3OH)_2SO_4$ and/or $(NH_3OH)_3PO_4$ are the preferred accelerators in a pickling process of this invention with the hydroxylamine sulfate salt being the most effective and thus most preferred accelerator.

It is therefore preferred in a pickling process according to the invention that at least 50%, more preferably at least 80% of the accelerators are based on hydroxylamine and/or their respective water soluble salts.

In order to sustain the pickling rate of the pickling process it is preferred that such a quantity of at least one such an accelerator selected from water soluble inorganic compounds comprising at least one nitrogen atom in an oxidation state in the range of −2 to −⅓, preferably selected from hydrazine, hydroxylamine and/or hydrazoic acid and their respective water soluble salts, more preferably selected from hydroxylamine and/or hydrazoic acid and their respective water soluble salts, even more preferably selected from hydroxylamine and their respective water soluble salts is continuously or discontinuously added to the pickling solution so that the total amount of water soluble inorganic compounds comprising at least one nitrogen atom in an oxidation state in the range of −2 to −⅓ is maintained at an amount of at least 0.01 g/l. preferably at least 0.1 g/l, more preferably at least 0.5 g/l calculated on a nitrogen basis.

Within such a preferred process the accelerators are added as contained in one or more aqueous solutions, while the aqueous solutions preferably have a pH in the range of 0 to 3.

According to the present invention sulfuric acid and phosphoric acid are the preferred strong acids with a pK-value for the first deprotonation step being less than 2.5, while sulfuric acid is the most preferred strong acid. Thus, within a preferred process the amount of free strong acids within the pickling solution is composed of at least 50 wt.-%, more preferably of at least 80 wt.-% of sulfuric acid.

In a pickling process according to the invention it is essential for a suitable pickling rate that the pickling solution possesses a redox potential of at least +230 mV. In a preferred pickling process the redox potential of the pickling solution is at least +300 mV, but not more than +800 mV.

The redox potential of the pickling solution is governed by the molar ratio of ferric ions to ferrous ions. This molar ratio can be regulated in various ways, among which the following are preferred:

- Addition of oxidizing agents with a standard reduction potential of at least +800 mV (SHE), e.g. persulphates, hydrogen peroxide, while addition of stabilized hydrogen peroxide is preferred; preferred stabilizing agents are phenacetin, compounds of the families of glycol ethers and aliphatic acids, and non-ionic surfactants terminally blocked with an aliphatic or aromatic group and their mixtures;
- Addition of oxidants in the gaseous state, such as air, oxygen-enriched air and oxygen, possibly in the presence of homogeneous or heterogeneous catalysts, in particular copper compounds dissolved in the pickling solution;
- Electrochemical oxidation of the pickling solution by means of an electrolysis In order to sustain the pickling rate of the pickling process it is preferred to continuously or discontinuously add such a quantity of one or more oxidizing agents with a standard reduction potential of at least +800 mV (SHE) to the pickling solution in a way that the molar ratio of ferric ions to ferrous ions in the pickling solution is maintained at a value of at least 0.2, preferably at least 0.5, more preferably at least 1, but preferably not more than 10, more preferably not more than 5.

Within such a preferred process the oxidizing agents are added as contained in one or more aqueous solutions different from those aqueous solution in a way that are added in order to maintain the amount of accelerators, while the aqueous solutions preferably have a pH in the range of 0 to 3.

The pickling process is preferably conducted in the temperature range from 15° C. to 65° C., more preferably from 20° C. to 55° C. The temperature depends to a large scale upon the type of steel and the type of plant. In this connection, of fundamental importance is the possibility of using, upstream of the chemical pickling process, mechanical descaling treatments.

It is very important to carry out efficient agitation of the pickling solution so as to ensure continuous renewal of the pickling solution that comes into contact with the stainless steel surface to be treated in a process according to this invention. In this respect, a preferred process involves spraying of the pickling solution. However, spraying is not always practical. In a preferred alternative the stainless steel surface to be treated is thus immersed or dipped into the pickling solution contained in a pickling bath. When the stainless steel surfaces are immersed or dipped into a pickling bath, an injection of air into the pickling solution is preferred in order to achieve a vigorous mixing of bath components and any replenisher, e.g. accelerator or oxidizing agent, that is added in order to maintain the pickling performance.

The stainless steel parts to be treated by the pickling process of this invention are not particularly limited and include the treatment of surfaces of wires, plates, rods, tubes and metal strips.

During the processing of stainless steel parts in any pickling line the contained pickling solution is steadily depleted with respect to the amount of accelerators that are consumed by heterogeneous reaction with the stainless steel surface. In addition the molar ratio of ferric ions to ferrous ions steadily decreases and thereby the oxidizing capability of the pickling solution itself. Therefore, it becomes necessary to replenish the amount of accelerators and to maintain a critical molar ratio of ferric ions to ferrous ions in order to sustain the pickling performance of a pickling solution that is steadily brought into contact with new non-pickled stainless steel surface area.

In case that metal strips are to be treated in a process according to this invention, the metal strip is immersed into a pickling bath containing the pickling solution through a conveyor belt or sprayed with the pickling solution while passing spray nozzles upon transport through the conveyor belt.

In such a constellation a preferred process of this invention consists in continuously adding oxidizing agents and/or accelerators to the pickling solution, which is either contained in a pickling bath or in a separate reservoir, in an amount that is proportional to the transportation speed of the stainless steel metal strip.

An alternative preferred process hereto consists in discontinuously adding oxidizing agents and/or accelerators to the pickling solution, which is either contained in a pickling bath or in a separate reservoir, wherein the time interval between two additions of the oxidizing agents or accelerators respectively is reciprocally proportional to the transportation speed of the stainless steel metal strip.

The present invention also encompasses an acidic aqueous solution which is especially suitable for the pickling of stainless steel and which can be therefore used as a pickling solution in any process according to this invention.

This acidic aqueous solution comprises a) 20 to 350 g/l calculated on a sulfate basis of at least one water soluble inorganic compound that acts as a source of sulfate anions, b) 9 to 150 g/l calculated on a fluorine basis of at least one fluorine-containing water soluble inorganic compound that acts as a source of fluoride, c) in total at least 0.01 g/l calculated on a nitrogen basis of one or more accelerators based on water soluble inorganic compounds comprising at least one nitrogen atom in an oxidation state in the range of −2 to −⅓ (hereinafter "accelerators"), d) not more than 100 g/l of iron ions, wherein the amount of free sulfuric acid is at least 20 g/l, but not more than 200 g/l calculated on a sulfate basis;

wherein the amount of free hydrofluoric acid is not more than 60 g/l calculated on a fluorine basis.

An acidic aqueous solution according to this invention is an efficient pickling agent for a variety of different stainless steel grades. The acidic aqueous solution gives rise to increased pickling rates compared to conventional pickling solutions at the same redox potential of the respective solutions. A considerable pickling of stainless steel surfaces is even observable for acidic aqueous solutions that do not comprise ferric ions.

In a preferred acidic aqueous composition of this invention at least 0.1 g/l, more preferably at least 0.5 g/l calculated on a nitrogen basis of the accelerators based on water soluble inorganic compounds comprising at least one nitrogen atom in an oxidation state in the range of −2 to −⅓ are contained. On the other hand amounts of such accelerators in excess of 20 g/l calculated on a nitrogen basis do not give rise to any further improvement of the pickling performance of the acidic aqueous solution. Amounts of the accelerator in excess of 5 g/l calculated on a nitrogen basis do only confer small additional advantages with respect to the pickling performance. Therefore, for economic reasons acidic aqueous solutions are preferred that do not comprise in total more than 20 g/l, more preferably in total not more than 5 g/l of accelerators calculated on a nitrogen basis.

In another preferred embodiment of the acidic aqueous solution the accelerators based on water soluble inorganic compounds comprising at least one nitrogen atom in an oxidation state in the range of −2 to −⅓ are selected from hydrazine, hydrazoic acid and/or hydroxylamine and their respective water soluble salts, preferably from hydrazoic acid and/or hydroxylamine and their respective water soluble salts, especially preferred from hydroxylamine and their respective water soluble salts. Among the salts of hydroxylamine $(NH_3OH)Cl$, $(NH_3OH)_2SO_4$ and/or $(NH_3OH)_3PO_4$ are the preferred accelerators in an acidic aqueous solution according to the invention with the hydroxylamine sulfate salt being the most effective and thus most preferred accelerator.

It is therefore preferred in a pickling process according to the invention that at least 50%, more preferably at least 80% of the accelerators are based on hydroxylamine and/or their respective water soluble salts.

It is further preferred that the acidic aqueous solution of this invention comprises at least 15 g/l of iron cations in order to be able to deploy a high enough oxidizing potential determined by the molar ratio of ferric ions to ferrous ions.

Although acidic aqueous solution according to the invention already reveal a considerable pickling rate in the absence of trivalent iron, it is preferred for an increased pickling performance of stainless steel grades that the acidic aqueous solution comprises at least 10 g/l, more preferably at least 15 g/l, but preferably not more than 60 g/l of ferric ions.

Those acidic aqueous solutions are especially suitable for the pickling of a variety of stainless steel grades for which a molar ratio of ferric ions to ferrous ions of at least 0.2, more preferably 0.5, even more preferably of 1.0 is established. For reasons of applicability in an industrial process such a molar ratio in a preferred acidic aqueous solution is not more than 10, more preferably not more than 5. Higher molar ratios of ferric ions to ferrous ions in an acidic aqueous solution according to the invention are difficult to maintain in a process for the pickling of stainless steel and do not justify these efforts from the perspective of gaining even higher pickling rates.

As a general rule, the redox potential of a preferred acidic aqueous solution is at least +230 mV, but preferably not more than +800 mV. Again an even more anodic redox potential of the acidic aqueous solution according to the invention is difficult to maintain in a process for the pickling of stainless steel; might give rise to over etching and blackening; and is therefore less preferred.

A preferred acidic aqueous solution according to this invention comprises at least 50 g/l of sulfuric acid in order to assist the pickling process, but does preferably not comprise more than 140 g/l in each case calculated on a sulfate basis.

With respect to the amount of free hydrofluoric acid a preferred acidic aqueous solution does comprise at least 2 WI free hydrofluoric acid in order to enhance the pickling rate, but does preferably not comprise more than 40 g/l free hydrofluoric acid in each case calculated on a fluorine basis.

A method to determine the amount of free hydrofluoric acid in acidic aqueous solutions suitable for the pickling of stainless steel is disclosed in EP 1141686 B1, paragraphs [0046]-[0061]. This disclosure is herein incorporated by reference.

The invention and the technical advantages are further characterized in the following examples.

A. Pickling Efficiency:

Table 1 refers to a standard acidic aqueous solution suitable for the pickling of stainless steel that is herein made use in order to show the influence of the accelerators on the pickling rate of the annealed and shot-blasted stainless steel samples.

TABLE 1

Composition of the standard pickling solution with a redox potential of +315 mV

| Compound | Actual amount in g/l |
|---|---|
| $H_2SO_4$ [1] | 125 |
| Hydrofluoric Acid [2] | 35 |
| Ferric ions [3] | 40 |
| Ferrous ions [4] | 20 |

[1] determined at 55° C. as free acid according to the Conductivity-Method as disclosed in EP 1141686 B1 after dilution with deionised water ($\kappa < 1\ \mu Scm^{-1}$) by a factor of 20

[2] difference between total free acid determined by acid-base titration of a sample of the standard pickling solution diluted with deionised water ($\kappa < 1\ \mu Scm^{-1}$) by a factor of 20 at 55° C. in the presence of methyl orange and the free sulfuric acid amount as measured according to footnote 1

[3] $Fe_2(SO_4)_3$ as a source; actual amount measured by iodometric titration after addition of an excess amount of $La(NO_3)_3$ so that the molar ratio of lanthanum to total fluorine is higher than 1:3 and dilution with deionised water ($\kappa < 1\ \mu Scm^{-1}$) by a factor of 50

[4] $FeSO_4$ as a source; actual amount measured by redox titration with potassium permanganate after addition of deionised water ($\kappa < 1\ \mu Scm^{-1}$) and acidification with $H_2SO_4$ to a pH ≤ 1 so that the sample is diluted by a factor of 50

Annealed and shot-blasted samples of hot rolled AIS1 304 (EN 1.4301) cut from industrial hot annealing and pickling line were immersed at 55° C. in an pickling solution according to Table 1 that additionally contained certain amounts of specific accelerators according to Table 2 (E1-E9). The pickling solutions were kept under constant agitation through mechanical stirring. Before the dip into pickling solutions, every sample was pre-heated in water at 55° C. for 10 minutes in order to avoid cooling of the evaluated systems.

Table 2 reports the average values of the pickling rate measured after the first 30 seconds of immersion with increasing concentration of $NaN_3$ (E1-E3), $(NH_3OH)_2SO_4$ (E4-E6) and $(NH_3OH)_3PO_4$ (E7-E9).

TABLE 2

Effect of Accelerators based on nitrogen compounds on pickling rate of stainless hot rolled AIS1 304 (average of 5 samples)

| Example | Accelerator | Amount* [g/l] | Pickling rate [1] [$g \cdot m^{-2} \cdot s^{-1}$] | Increase of pickling rate |
|---|---|---|---|---|
| C1 | none | — | 27.4 | — |
| E1 | $NaN_3$ | 0.07 | 30.6 | +12% |
| E2 | " | 0.65 | 35.3 | +29% |
| E3 | " | 2.60 | 42.6 | +56% |
| E4 | $(NH_3OH)_2SO_4$ | 0.02 | 28.0 | +2% |
| E5 | " | 0.17 | 33.4 | +22% |
| E6 | " | 0.68 | 35.7 | +30% |
| E7 | $(NH_3OH)_3PO_4$ | 0.85 | 34.1 | +20% |

*calculated on a nitrogen basis

[1] calculated as the sample weight difference before and after immersion in the pickling solution divided by the immersion time and sample surface area; after immersion the samples were blow-dried in a nitrogen stream prior to weighing The presence of the additive (E1-E3) led to an increase of pickling rate referred to the solution (C1) with no $NaN_3$. A steady increase of the pickling rate could be observed with an increasing amount of the accelerator $NaN_3$. The same was observed for salts of hydroxylamines that as well revealed an increase of pickling efficiency compared to the standard pickling solution (C1). Moreover, it was observed that $NaN_3$ and $(NH_3OH)_2SO_4$ confer the same increase in pickling efficiency based on their amount as calculated on a nitrogen basis (E2 vs. E6). The hydroxylamine phosphate salt was less effective than the corresponding sulfate salt (E7 vs. E6) but still revealed a considerable increase in the pickling efficiency compared to the standard pickling solution (C1).

In general it is evident from Table 2 that acidic aqueous solutions according to the invention increase the pickling efficiency compared to a pickling solution as known in the prior art.

B. Material Loss:

In the following the influence of the addition of accelerators selected from azides and hydroxylamines on the pickling of the stainless steel base material is presented.

Stainless steel samples with no surface layer of oxide scale were prepared by immersing annealed and shot-blasted samples of hot rolled AIS1 304 (EN 1.4301) cut from an industrial hot annealing and pickling line at 55° C. in the pickling solution as reported in Table 1. Subsequent to this pickling treatment the stainless steel samples were rinsed with water and blow-dried with a nitrogen stream.

These pickled samples were immersed at 55° C. for 180 seconds in acidic aqueous solutions that were either a standard pickling solution (C2) known in the prior art or acidic aqueous solutions according to the invention (F1-F7). The acidic aqueous solutions were kept under constant agitation through mechanical stirring. After this immersion the samples were rinsed with water and blow-dried with a nitrogen stream.

It is evident from Table 3 that the etching of the base material in acidic aqueous compositions according to the invention (F1-F7) is less pronounced than within a conventional pickling solution. Therefore, the material loss during a pickling process of stainless steel can be effectively reduced. Hydroxylamine salts such as $(NH_3OH)_3PO_4$ may reduce the material loss by approximately 10%. The hydroxylamine salt is much more effectively reducing the material loss than the sodium azide containing pickling solution (F2 vs. F6).

TABLE 3

Effect of Accelerators based on nitrogen compounds on the pickling of the AIS1 304 base material (average of 5 samples)

| Example | Accelerator | Amount* [g/l] | Weight loss [1] [$g \cdot m^{-2}$] |
|---|---|---|---|
| C2 | none | — | 16.9 |
| F1 | $NaN_3$ | 0.07 | 17.0 |
| F2 | " | 0.65 | 16.9 |
| F3 | " | 2.60 | 15.8 |
| F4 | $(NH_3OH)_3PO_4$ | 0.02 | 16.0 |
| F5 | " | 0.17 | 15.6 |
| F6 | " | 0.68 | 15.2 |
| F7 | " | 1.70 | 15.0 |

*calculated on a nitrogen basis

[1] calculated as the sample weight difference of the blow-dried steel sample before and after immersion in the acidic aqueous solution according to C2; F1-F7

The invention claimed is:

1. An acidic aqueous solution suitable for the pickling of stainless steel comprising a) 20 to 350 g/l calculated on a sulfate basis of at least one water soluble inorganic compound that acts as a source of sulfate anions, b) 9 to 150 g/l calculated on a fluorine basis of at least one fluorine-containing water soluble inorganic compound that acts as a source of fluoride, c) in total at least 0.01 g/l calculated on a nitrogen basis of one or more accelerators based on water soluble inorganic compounds comprising at least one nitrogen atom in an oxidation state in the range of −2 to −⅓, d) not more than 100 g/l of iron ions, wherein free sulfuric acid is present in an amount of at least 20 g/l, but not more than 200 g/l calculated on a sulfate basis;

wherein free hydrofluoric acid is present in an amount of not more than 60 g/l calculated on a fluorine basis; and wherein the solution has a redox potential of at least +230 mV.

2. The acidic aqueous solution according to claim 1, wherein the amount of accelerators based on water soluble inorganic compounds comprising at least one nitrogen atom in an oxidation state in the range of −2 to −⅓ is not more than 20 g/l, but at least 0.1 g/l, calculated on a nitrogen basis.

3. The acidic aqueous solution according to claim 1, wherein the accelerators based on water soluble inorganic compounds comprising at least one nitrogen atom in an oxidation state in the range of −2 to −⅓ are selected from hydrazine, hydrazoic acid, hydroxylamine, water soluble salts of hydrazine, water soluble salts of hydrazoic acid, water soluble salts of hydroxylamine and mixtures thereof.

4. The acidic aqueous solution according to claim 1 wherein iron ions are present in an amount of at least 15 g/l.

5. The acidic aqueous solution according to claim 1 wherein the iron ions are present and comprise at least 10 g/l, but not more than 60 g/l of ferric ions.

6. The acidic aqueous solution according to claim 4 wherein the solution has a molar ratio of ferric ions to ferrous ions of at least 0.2, and not more than 10.

7. The acidic aqueous solution according to claim 1 wherein the solution has a redox potential not more than +800 mV.

8. A process for the pickling of stainless steel wherein a stainless steel surface is brought into contact with a pickling solution comprising:

a) 0.2 to 2.1 mol/l of at least one strong free acid with a pK-value of the first deprotonation step below 2.5;

b) 0.4 to 79 mol/l of total fluoride;

c) 0.25 to 2 mol/l of iron ions;

d) at least 0.01 g/l calculated on a nitrogen basis of one or more accelerators based on water soluble inorganic compounds comprising at least one nitrogen atom in an oxidation state in the range of −2 to −⅓;

wherein the redox potential of the pickling bath is at least +230 mV.

9. The process according to claim 8 wherein the at least one strong free acid comprises at least 50 wt.-% of free sulfuric acid.

10. The process according to claim 8, a quantity of one or more oxidizing agents with a standard reduction potential of at least +800 mV (SHE) is continuously or discontinuously added to the pickling solution such that the pickling solution has molar ratio of ferric ions to ferrous ions maintained at a value of at least 0.2, but not more than 10.

11. The process according to claim 8 wherein at least one accelerator selected from water soluble inorganic compounds comprising at least one nitrogen atom in an oxidation state in the range of −2 to −⅓, is continuously or discontinuously added to the pickling solution such that a total amount of water soluble inorganic compounds comprising at least one nitrogen atom in an oxidation state in the range of −2 to −⅓ is maintained at an amount of at least 0.01 g/l calculated on a nitrogen basis.

12. The process according to claim 10, wherein the oxidizing agents are contained in one or more aqueous solutions.

13. The process according to claim 12, wherein the accelerators are contained in one or more aqueous solutions different from the solutions containing the oxidizing agents.

14. The process according to claim 8 wherein the one or more accelerators based on water soluble inorganic compounds comprising at least one nitrogen atom in an oxidation state in the range of −2 to −⅓ are selected from hydrazine, hydrazoic acid, hydroxylamine, water soluble salts of hydrazine, water soluble salts of hydrazoic acid, water soluble salts of hydroxylamine and mixtures thereof.

15. The process according to claim 8, wherein the stainless steel surface is a surface of a metal strip.

16. An article of manufacture comprising a stainless steel metal strip treated according to the process to claim 8.

* * * * *